US009410323B1

(12) United States Patent
Leitch

(10) Patent No.: US 9,410,323 B1
(45) Date of Patent: Aug. 9, 2016

(54) ROOFING SHINGLE SYSTEM AND SHINGLES FOR USE THEREIN

(71) Applicant: Building Materials Investment Corporation, Dallas, TX (US)

(72) Inventor: Olan Leitch, Bakersfield, CA (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 14/656,902

(22) Filed: Mar. 13, 2015

(51) Int. Cl.
*E04D 1/00* (2006.01)
*E04D 1/26* (2006.01)
*E04D 1/12* (2006.01)

(52) U.S. Cl.
CPC ... *E04D 1/12* (2013.01); *E04D 1/26* (2013.01); *E04D 2001/005* (2013.01)

(58) Field of Classification Search
CPC ..... E04D 2001/005; E04D 1/125; E04D 1/08; E04D 1/12; E04D 1/025; E04D 1/20; E04D 1/26; E04D 3/24; E04D 3/32; B32B 11/02; B32B 11/10
USPC ..... 52/554, 523, 524, 535, 546; D25/139
See application file for complete search history.

(56) References Cited

U.S. PATENT DOCUMENTS

| | | | | | |
|---|---|---|---|---|---|
| 433,279 | A | | 7/1890 | Fairchild | |
| 1,295,360 | A | | 2/1919 | Overbury | |
| D56,106 | S | * | 8/1920 | Russell | D25/139 |
| 1,442,614 | A | * | 1/1923 | Hooker | 52/523 |
| 1,463,632 | A | * | 7/1923 | Severns | E04D 1/26 52/546 |
| 1,513,940 | A | | 11/1924 | Smith et al. | |
| D68,552 | S | | 10/1925 | Sjodahl | |
| 1,584,343 | A | * | 5/1926 | Abraham | 52/557 |
| 1,587,017 | A | * | 6/1926 | Macinnes | 52/526 |
| 1,601,735 | A | * | 10/1926 | Harris | 52/524 |
| 1,604,339 | A | * | 10/1926 | Cumfer | 52/519 |
| 1,619,599 | A | | 3/1927 | Cumfer | |
| 1,633,474 | A | * | 6/1927 | Busha | 52/555 |
| 1,641,858 | A | | 9/1927 | McCarthy | |
| 1,655,885 | A | * | 1/1928 | Adair | 52/555 |
| 1,656,434 | A | * | 1/1928 | Gietz | 52/526 |
| D74,669 | S | * | 3/1928 | Fife | D25/139 |
| D75,612 | S | * | 6/1928 | Cotner | D25/139 |
| 1,688,917 | A | * | 10/1928 | Busha | 52/555 |
| D76,843 | S | * | 11/1928 | Topping | D25/139 |
| 1,698,891 | A | | 1/1929 | Overbury | |
| 1,555,441 | A | | 9/1929 | Sjodahl | |
| 1,732,403 | A | * | 10/1929 | Harris et al. | 52/555 |

(Continued)

OTHER PUBLICATIONS

CertainTeed Shingle Applicator's Manual: Presidential Shake and Presidential Shake TL, http://www.certainteed.com/resources/PresidentialShakeTLInstall.pdf (undated).

(Continued)

*Primary Examiner* — Joshua J Michener
*Assistant Examiner* — Matthew Gitlin
(74) *Attorney, Agent, or Firm* — Fitzpatrick, Cella, Harper & Scinto

(57) ABSTRACT

A roofing system is provided comprising a multiplicity of courses of roofing shingles having a reduced-width headlap portion and a non-straight longitudinal front edge, wherein a lateral trailing edge of a shingle in a single course overlaps (side-laps) an adjacent previously installed shingle, and where the buttlap portion includes an exposed buttlap portion having a surface area that is greater than the surface area of the headlap portion.

17 Claims, 9 Drawing Sheets

(56) References Cited

U.S. PATENT DOCUMENTS

| | | | | | |
|---|---|---|---|---|---|
| 1,741,539 | A | | 12/1929 | Moore | |
| 1,756,741 | A | | 4/1930 | Harshberger et al. | |
| 1,760,873 | A | * | 6/1930 | Kirschbraun | 52/557 |
| D81,768 | S | * | 8/1930 | Topping | D25/139 |
| D83,704 | S | * | 3/1931 | Stark | D25/139 |
| 1,828,222 | A | | 10/1931 | Clow | |
| D85,639 | S | | 12/1931 | Finley | |
| 1,842,761 | A | | 1/1932 | McCarthy | |
| 1,843,370 | A | * | 2/1932 | Overbury | 427/187 |
| 1,846,635 | A | * | 2/1932 | Finley | 83/56 |
| 1,851,088 | A | * | 3/1932 | Duncan | 52/524 |
| 1,860,899 | A | | 5/1932 | Miller | |
| 1,862,852 | A | | 6/1932 | Harshberger | |
| 1,871,646 | A | * | 8/1932 | Abraham | E04D 1/20 52/105 |
| 1,894,614 | A | | 1/1933 | Wettlaufer | |
| 1,903,023 | A | * | 3/1933 | Black | 52/554 |
| D89,783 | S | * | 5/1933 | Moone | D25/139 |
| 1,934,666 | A | * | 11/1933 | Goslin | 52/523 |
| 1,945,485 | A | | 1/1934 | Harshberger | |
| 1,955,699 | A | * | 4/1934 | Moffit | E04D 1/34 52/543 |
| 1,956,732 | A | | 5/1934 | Schulz | |
| D92,504 | S | * | 6/1934 | Topping | D25/139 |
| 1,968,426 | A | * | 7/1934 | Rowe | E04D 1/22 52/548 |
| 1,975,487 | A | * | 10/1934 | Topping | 83/37 |
| D93,824 | S | | 11/1934 | Harshberger | |
| 1,983,936 | A | | 12/1934 | Finley | |
| 2,000,226 | A | * | 5/1935 | Fry | 427/284 |
| 2,006,417 | A | | 7/1935 | Topping | |
| 2,018,722 | A | * | 10/1935 | Humphrey | E04D 1/22 52/524 |
| 2,027,029 | A | | 1/1936 | Eckert | |
| D99,248 | S | | 4/1936 | Piazza | |
| 2,068,118 | A | * | 1/1937 | Topping | 52/555 |
| 2,078,998 | A | * | 5/1937 | Black | E04D 1/22 52/526 |
| D107,209 | S | | 11/1937 | Batell | |
| 2,099,131 | A | | 11/1937 | Miller | |
| 2,106,396 | A | * | 1/1938 | Topping | E04D 1/22 52/518 |
| 2,113,644 | A | | 4/1938 | Bollaert | |
| 2,132,999 | A | | 10/1938 | Topping | |
| 2,161,440 | A | | 6/1939 | Venrick | |
| 2,205,679 | A | * | 6/1940 | Ames, Jr. | 52/554 |
| 2,219,450 | A | | 10/1940 | Koenig | |
| 2,257,152 | A | | 9/1941 | Black | |
| 2,272,032 | A | | 2/1942 | Brown | |
| 2,335,493 | A | * | 11/1943 | Drinkall | 52/314 |
| 2,411,308 | A | | 11/1946 | Washburn | |
| 2,460,353 | A | | 2/1949 | Killingsworth | |
| 2,487,593 | A | * | 11/1949 | Rowe | 52/105 |
| 2,687,701 | A | | 8/1954 | Abraham | |
| 2,699,129 | A | | 1/1955 | Abraham | |
| 2,756,699 | A | * | 7/1956 | Lockwood | E04D 1/16 52/546 |
| 2,808,010 | A | * | 10/1957 | Rannikko | 52/554 |
| 2,858,777 | A | * | 11/1958 | Schuetz | E04D 1/20 52/554 |
| 2,867,180 | A | | 1/1959 | May | |
| 2,884,878 | A | | 5/1959 | Abraham | |
| 3,127,701 | A | | 4/1964 | Jastrzemski | |
| 3,217,870 | A | | 11/1965 | Davis et al. | |
| 3,283,463 | A | | 11/1966 | Powell | |
| 3,377,761 | A | * | 4/1968 | Skelton, Jr. | 52/530 |
| 3,407,556 | A | | 10/1968 | Leibrook | |
| 3,638,388 | A | | 2/1972 | Crookston | |
| 3,919,223 | A | | 11/1975 | Zmojdzin et al. | |
| 3,919,823 | A | | 11/1975 | Bradley | |
| 3,921,358 | A | | 11/1975 | Bettoli | |
| 4,188,763 | A | * | 2/1980 | Thiis-Evensen | 52/557 |
| 4,195,461 | A | * | 4/1980 | Thiis-Evensen | 52/557 |
| 4,274,243 | A | * | 6/1981 | Corbin et al. | 52/748.1 |
| 4,333,279 | A | | 6/1982 | Corbin et al. | |
| 4,434,589 | A | | 3/1984 | Freiborg | |
| 4,499,702 | A | | 2/1985 | Turner | |
| 4,527,374 | A | | 7/1985 | Corbin | |
| 4,587,785 | A | * | 5/1986 | Rohner | E04D 1/26 52/420 |
| 4,637,191 | A | | 1/1987 | Smith | |
| 4,666,226 | A | | 5/1987 | Legrand et al. | |
| 4,856,251 | A | | 8/1989 | Buck | |
| D317,506 | S | * | 6/1991 | Jenkins et al. | D25/139 |
| D326,330 | S | | 5/1992 | Klein | |
| 5,195,290 | A | | 3/1993 | Hulett | |
| 5,232,530 | A | | 8/1993 | Malmquist et al. | |
| 5,239,802 | A | | 8/1993 | Robinson | |
| 5,421,134 | A | | 6/1995 | Hannah et al. | |
| D366,124 | S | * | 1/1996 | Hannah et al. | D25/139 |
| 5,495,654 | A | | 3/1996 | Goodhart et al. | |
| 5,657,603 | A | | 8/1997 | Goodhart et al. | |
| D388,195 | S | | 12/1997 | Hannah et al. | |
| 5,799,459 | A | | 9/1998 | Covert | |
| 5,816,014 | A | * | 10/1998 | Tzeng et al. | 52/745.19 |
| D400,981 | S | | 11/1998 | Bondoc et al. | |
| 5,853,858 | A | | 12/1998 | Bondoc | |
| 5,860,263 | A | | 1/1999 | Sieling et al. | |
| D406,361 | S | | 3/1999 | Bondoc et al. | |
| D406,665 | S | | 3/1999 | Bondoc et al. | |
| 5,939,169 | A | * | 8/1999 | Bondoc et al. | 428/141 |
| 6,014,847 | A | * | 1/2000 | Phillips | 52/311.1 |
| D426,002 | S | | 5/2000 | Bondoc et al. | |
| D435,671 | S | | 12/2000 | Phillips | |
| 6,190,754 | B1 | | 2/2001 | Bondoc et al. | |
| 6,361,851 | B1 | | 3/2002 | Sieling et al. | |
| 6,367,222 | B1 | | 4/2002 | Timbrel et al. | |
| D480,485 | S | | 10/2003 | Phillips | |
| D482,141 | S | | 11/2003 | Rodrigues et al. | |
| D484,992 | S | | 1/2004 | Rodrigues et al. | |
| 6,708,456 | B2 | | 3/2004 | Kiik et al. | |
| 6,920,730 | B2 | | 7/2005 | Becker et al. | |
| 6,990,779 | B2 | | 1/2006 | Kiik et al. | |
| 7,204,063 | B2 | | 4/2007 | Kandalgaonkar | |
| 7,510,622 | B2 | | 3/2009 | Kalkanoglu et al. | |
| 7,607,275 | B2 | | 10/2009 | Elliott et al. | |
| 7,775,008 | B2 | * | 8/2010 | King | 52/519 |
| D658,787 | S | | 5/2012 | Westfall et al. | |
| D666,745 | S | | 9/2012 | Rodrigues et al. | |
| D666,747 | S | | 9/2012 | Rodrigues et al. | |
| D670,407 | S | | 11/2012 | Leitch | |
| D670,408 | S | | 11/2012 | Leitch | |
| D670,409 | S | | 11/2012 | Leitch | |
| D670,825 | S | | 11/2012 | Leitch | |
| D670,826 | S | | 11/2012 | Leitch | |
| D670,827 | S | | 11/2012 | Leitch | |
| D674,515 | S | * | 1/2013 | Jenkins | D25/139 |
| D695,925 | S | | 12/2013 | Ray et al. | |
| 9,057,194 | B2 | | 6/2015 | Jenkins et al. | |
| 9,242,432 | B1 | | 1/2016 | Harrington et al. | |
| 2003/0110729 | A1 | | 6/2003 | Waggoner et al. | |
| 2003/0172611 | A1 | * | 9/2003 | Coco et al. | 52/554 |
| 2004/0079042 | A1 | * | 4/2004 | Elliott | 52/557 |
| 2004/0172909 | A1 | | 9/2004 | Gabbard et al. | |
| 2004/0182032 | A1 | | 9/2004 | Koschitzky | |
| 2007/0068108 | A1 | | 3/2007 | Kiik et al. | |
| 2009/0100788 | A1 | | 4/2009 | Gabbard et al. | |
| 2009/0151288 | A1 | | 6/2009 | Kalkanoglu et al. | |
| 2009/0229210 | A1 | | 9/2009 | Binkley et al. | |
| 2011/0185668 | A1 | | 8/2011 | Kiik et al. | |
| 2013/0160389 | A1 | | 6/2013 | Leitch | |

OTHER PUBLICATIONS

Pending U.S. Appl. No. 14/947,220 filed Nov. 20, 2015 (drawings attached).

* cited by examiner

ROOFING SHINGLE SYSTEM AND SHINGLES FOR USE THEREIN

FIELD OF THE INVENTION

This invention relates to an improved roofing system and roofing shingles that may be utilized in the roofing system. In particular, the invention relates to roofing shingles featuring unique dimensions and a roofing system that utilizes the shingles.

BACKGROUND OF THE INVENTION

Roofing products are often divided into three broad groups: shingles, roll roofing, and underlayment. Shingles and roll roofing typically function as outer roof coverings designed to withstand exposure to weather and the elements. Shingles and roll roofing generally contain the same basic components which provide protection and long term wear associated with asphalt roofing products. These components include a base material made from an organic felt or fiberglass mat which serves as a matrix to support the other components and gives the product the required strength to withstand manufacturing, handling, installation and service in the intended environment. An asphalt coating formulated for the particular service application is often applied to the base material to provide the desired long-term ability to resist weathering and to provide stability under temperature extremes. An outer layer of mineral granules is also commonly applied to the asphalt coating to form a surface exposed to the weather which shields the asphalt coating from the sun's rays, adds color to the final product and provides fire resistance.

Typically, shingles are installed on a roof deck such that the shingles are in a row from left to right and the lateral edges of the shingles in the row are contiguous with each other so as to abut each other, i.e. their lateral edges are adjacent to one another. Each row represents a course and the shingles are applied in overlapping courses on the roof deck, wherein the buttlap portion of a subsequent course is placed on the headlap portion of a previous course. The headlap portion of a conventional shingle is at least as wide as the buttlap portion of the shingle so that when the shingles are installed on a roof deck in overlapping courses, the entire buttlap portion of a subsequent course has headlap beneath it. This manner of installation prevents leakage to the roof deck where the lateral edges of the shingles abut each other.

In a typical roofing system, contiguous shingles in a row abut each other at their lateral edges. Thus, when the shingles are exposed to wet weather, it is possible that leakage can occur at the region where the shingles abut. To prevent that, overlapping subsequent rows of shingles are installed in an offset pattern and each shingle's headlap portion is at least as wide as the buttlap portion. Thus, when the shingles are applied to the roof in a plurality of courses and the buttlap portion of a second course of shingles is laid over the headlap portion of a first row of shingles there is always headlap present underneath the regions where the contiguous shingles in a row abut. Any water penetrating the places where lateral edges of shingles abut contacts the underlying headlap rather than the roof deck.

Asphalt shingles are among the most commonly used roofing materials. Asphalt shingles, such as those disclosed in U.S. Pat. No. 6,990,779, have been used extensively in residential housing as roof covering due to their aesthetics, ease of installation, water shedding function, and excellent field performance over a long period of time. U.S. Pat. No. 6,990,779 discloses a laminated roofing shingle system including a reduced-width headlap portion and an interply material that is installed under the buttlap portion in order to compensate for the reduced-width headlap portion and provide protection to the roof deck.

In some cases, prior art shingles may rely on redundant overlapping to ensure adequate water shedding performance, particularly in high wind or wind-driven rain conditions. For example, a typical prior art shingle know as a "3-tab shingle" would require approximately 240 $ft^2$ of sheet material to cover a 100 $ft^2$ of roof area (also known as a "square"). Other types of shingles also require significantly high amounts of overlapping materials to achieve adequate performance for resistance to water infiltration.

Single-layer strip shingles present a low cost roofing option, but presently available strip shingles are still more expensive than some consumers would like for homes, sheds, or other low cost buildings.

As energy costs rise, the cost of petroleum-based materials, such as asphalt, and transportation expenses often rise as well. The amount of material employed in a shingle can contribute to costs of the shingle and the overall weight of the shingle, which also affects transportation costs. Certain design requirements, such as a two inch or 2¼ inch material overlap from any point of water entry, constrain the possible dimensions for a shingle. Decreasing the amount of asphalt, substrate, and other materials required to make a shingle while maintaining the equivalent performance and coverage area can reduce both material costs and transportation expenses to deliver such shingles. Material costs (and transportation expenses) can be further reduced by maximizing the exposure (or coverage) of each individual shingle by requiring fewer shingles to cover a roof deck.

Various shingles have been developed that employ a shiplap or side-lap feature such that when applied to a roof deck at least part of the lateral edges of neighboring shingles overlap. U.S. Pat. No. 2,106,396 discloses single layer asphalt coated shingles having serrated edges having edge and corner elements. When the shingles are applied to a roof deck, their lateral edges overlap. The edge and corner elements of the shingles may be utilized as guides for laying the elements of each shingle in proper relation to each other in each course and also for properly relating the elements in one course to those in a subjacent course.

U.S. Pat. No. 2,272,032 describes single layer asphalt roofing shingles with varying cross-sectional thickness to be arranged in offset overlapping courses, wherein the side edge portions of adjacent shingles in the same course overlap. The shingle has longitudinal zigzag edge contours, which shadow each other on either side of the shingle such that the width of the shingle is constant across the length of the shingle. When the courses are installed, the thicker portions of a subsequent shingle "nest" in the thinner portions of the previously installed shingle to provide the protection qualities of more heavily coated roofing material.

U.S. Pat. No. 2,687,701 discloses single layer tabbed asbestos cement roofing shingles comprising projections on the front and rear edges. When the shingles are applied to a roof deck, their lateral edges overlap. The shingles comprise projections which extend above and over the buttlap portion of a previous course when a subsequent course is installed. The overlapping and projections are intended to create a more dimensional appearance.

U.S. Pat. No. 3,919,823 discloses single layer asphalt roofing shingles. The shingles comprise various projections on the front edge. The shingles are installed such that their lateral edges overlap to create what is described as a "shadow effect" which will vary depending on the time of day.

U.S. Pat. No. 4,274,243 discloses a laminated asphalt roofing shingle to be arranged in overlapping courses to optically simulate tiles. The shingle has a buttlap portion with curved tile-like features and the left-most tile-like feature includes an overlap portion that extends over the adjoining edge of a neighboring shingle to hide the adjoining edge between the shingles.

U.S. Pat. Nos. 4,333,279 and 4,527,374 disclose strip or tabbed single layer asphalt shingles. The shingles comprise various edges at least one of which is an alignment edge. The shingles are overlapped using the alignment edge in order to achieve a desired pattern when the shingles are installed on a roof deck.

U.S. Pat. Appl. Publ. No. 2004/0182032 discloses a multilayer laminate shingle with a reduced-width headlap portion. The shingle has a base layer and at least a second layer above the base layer. At one end of the shingle the base layer projects beyond the second layer while at the other end the second layer projects beyond the base layer. When the shingles are laid in a course along the roof, the projecting end of the second layer overlaps the projecting end of the base layer of the previously installed shingle, forming a shiplap joint over all or substantially all of the width of the shingle.

U.S. Pat. Appl. Publ. No. 2011/0185668 discloses a laminated roofing shingle system including a reduced-width headlap portion, wherein the roofing system comprises a plurality of courses, and wherein a trailing edge of a subsequently installed shingle in a course overlaps the leading edge of an adjacent previously installed shingle in the same course.

In addition to certain of the shingles discussed above, various shingles have employed non-straight edge contours. U.S. Pat. No. 1,732,403 discloses a tabbed strip shingle and method of forming the shingle. The shingles are cut from a sheet of roofing material, wherein the front edge profile of the shingles are cut with a zigzag pattern to form complementary shingles. The tabs of the shingles are separated by parallel slots and have a generally triangular front edge with a small horizontal tip portion. When installed, the small horizontal tip portion of the tabs of shingles in a subsequently installed course align with the ends of the slots of shingles in a previously installed course. The shingles require approximately 225 $ft^2$ of sheet material to cover a 100 $ft^2$ of roof area.

U.S. Pat. No. 1,846,635 discloses a method of cutting so-called hexagonal strip shingles without waste from a parent sheet of prepared roofing. Each shingle has an exposed edge that defines projecting tongues having three sides of a hexagonal shape separated by recesses. When installed the projecting tongues match with the recesses of previously installed shingles, i.e., the projecting tongues have an end breadth equal to the breadth of the recesses in the buttlap. The shingles may also have a headlap with projections and recesses, wherein the end breadths of the headlap projections are equal to the headlap recesses and different from the tongue end breadths and buttlap recesses. U.S. Pat. No. 1,846,635 further discloses a formula for calculating the average exposed width of the shingle and that the shingle has a maximum width ("extreme width") that is twice the average exposed width plus the desired overlap from a successively installed shingle.

U.S. Pat. Appl. Publ. No. 2003/0172611 discloses shingles having a headlap region and a visual feature region, wherein the visual feature region includes teeth and cutout spaces that are identical in shape and size, with respect to each other. When installed, an alternating pattern is achieved along a vertical line extending up the shingled roof between teeth and cutout spaces of the visual feature regions of overlapped, vertically adjacent shingles.

U.S. Pat. Appl. Publ. No. 2013/0160389 discloses shingles having a headlap portion with a non-straight longitudinal edge and a buttlap portion with a non-straight longitudinal edge, wherein the non-straight longitudinal edges do not shadow each other laterally across the shingle. U.S. Pat. Appl. Publ. No. 2013/0160389 further discloses a roofing system wherein at least a portion of the headlap portion of a shingle in a subsequently installed course overlaps at least a portion of the headlap portion of a shingle in a previously installed course and a maximum headlap overlap dimension is beneath the subsequently installed shingle laterally proximate the openings in the buttlap portion of the subsequently installed shingle. U.S. Pat. Appl. Publ. No. 2013/0160389 further discloses a method of making the shingles wherein the shingles are cut from a sheet of roofing material longitudinally along non-straight lines.

Each of the above-referenced patents and patent applications is incorporated herein by reference in their entirety for all purposes within this application.

SUMMARY OF THE INVENTION

In accordance with the present invention, a roofing system is provided having a multiplicity of courses of roofing shingles having a reduced-width headlap portion and a non-straight longitudinal front edge, wherein a lateral trailing edge of a shingle in a single course overlaps (side-laps) an adjacent previously installed shingle, and wherein the buttlap portion includes an exposed buttlap portion having a surface area that is greater than the surface area of the headlap portion.

One embodiment of this invention pertains to a new asphalt containing roofing shingle that improves upon the utilization of materials required to make the shingle compared to prior art strip shingles while improving upon the aesthetic appearance of prior art strip shingles.

A preferred embodiment of the present invention pertains to a shingle, wherein the shingle has a non-straight longitudinal front edge and alignment notches. When installed on a roof deck in a side-lap fashion, the non-straight longitudinal front edge and alignment notches enable an increase in shingle exposure and maintain leak resistance.

In a preferred embodiment, a roofing system is provided comprising single-layer shingles having a headlap portion and a buttlap portion, wherein the headlap portion has a maximum headlap width that is less than a maximum buttlap width of the buttlap portion, wherein the buttlap portion includes a non-straight longitudinal front edge having a central horizontal portion, a left horizontal portion, a right horizontal portion, a first transition portion, and a second transition portion, wherein the central horizontal portion extends away from the shingle to define a first buttlap width, the left horizontal portion and right horizontal portion each extends away from the shingle to define a second buttlap width, and wherein the first transition portion is situated between the left horizontal portion and the central horizontal portion and the second transition portion is situated between the central horizontal portion and the right horizontal portion, wherein the roofing system comprises a plurality of courses of the shingles, and wherein a trailing lateral edge of a subsequently installed shingle in a first course of shingles overlaps a leading lateral edge of an adjacent previously installed shingle in the first course to provide a side-lap region, and wherein the buttlap portion includes an exposed buttlap portion, and wherein the exposed buttlap portion has a surface area that is greater than the surface area of the headlap portion.

In another embodiment, the roofing system consists essentially of the shingles of the invention.

In a preferred embodiment, the headlap portion is surfaced with a first shade of granules and the buttlap portion is surfaced with a second shade of granules.

In a preferred embodiment, the headlap portion includes an exposed headlap portion.

In a preferred embodiment, the maximum headlap width is less than 50% the maximum buttlap width. In a further preferred embodiment, the maximum headlap width is about 33% the maximum buttlap width.

In a preferred embodiment, the first buttlap width is the maximum buttlap width. In a further preferred embodiment, the first buttlap width is about 1" greater than the second buttlap width.

In another preferred embodiment, the second buttlap width is the maximum buttlap width. In a further preferred embodiment, the first buttlap width is about 1" less than the second buttlap width.

In another preferred embodiment, the headlap portion includes a non-straight longitudinal rear edge having a central horizontal portion, a left horizontal portion, a right horizontal portion, a first transition portion, and a second transition portion, wherein the central horizontal portion extends away from the shingle to define a first headlap width, the left horizontal portion and right horizontal portion each extends away from the shingle to define a second headlap width, and wherein the first transition portion is situated between the left horizontal portion and the central horizontal portion and the second transition portion is situated between the central horizontal portion and the right horizontal portion.

In a preferred embodiment, the second headlap width is the maximum buttlap width. In a further preferred embodiment, the first headlap width is about 1" less than the second headlap width.

In a preferred embodiment, the shingles further comprise a first set of alignment notches, wherein a first alignment notch from the first set of alignment notches is situated on the trailing lateral edge of a subsequently installed shingle in a subsequent course of shingles and lines up with a longitudinal rear edge of the headlap portion of a previously installed shingle in the first course of shingles.

In a further preferred embodiment, the shingles further comprise a second set of alignment notches situated on the longitudinal rear edge of the headlap portion, wherein a first alignment notch from the second set of alignment notches lines up with the trailing lateral edge of a subsequently installed shingle in a first course of shingles.

In another preferred embodiment, the non-straight longitudinal front edge includes a longitudinal front edge slot opening situated approximately at the longitudinal center of the shingle.

In a particularly preferred embodiment, the shingles further comprise sealant strips on the bottom side of the shingle situated near the non-straight longitudinal front edge.

The roofing system of the invention is an improvement of roofing systems known in the art, wherein the improvements are providing roofing shingles having a reduced-width headlap and a unique shape and/or dimensions, which provide an increased coverage for each shingle of the invention compared to prior art shingles and allows for increased utilization of materials necessary to make the shingles of the invention compared to the amount of material necessary to make traditional, prior art shingles.

A further improvement is providing roofing shingles having large exposure areas and improved aesthetics that can be manufactured at current strip shingle plants with little mechanical changes to the plants.

DETAILED DESCRIPTION OF THE FIGURES

For a more complete understanding of the present invention, and the advantages thereof, reference is now made to the following descriptions taken in conjunction with the accompanying figures, but which are not to be construed as limiting to the scope of the present invention as defined by the appended claims, in which:

Figure 10:
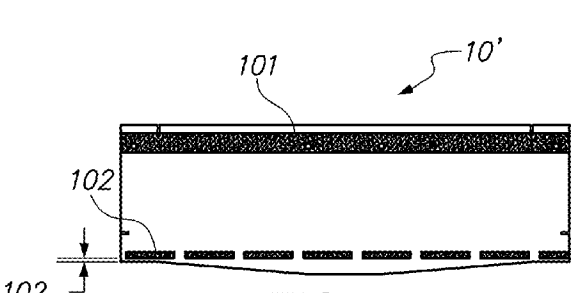
Figure 12A:
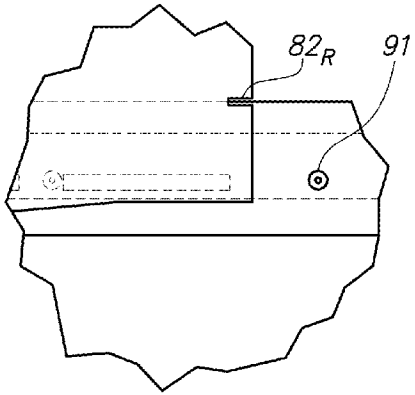
Figure 9:
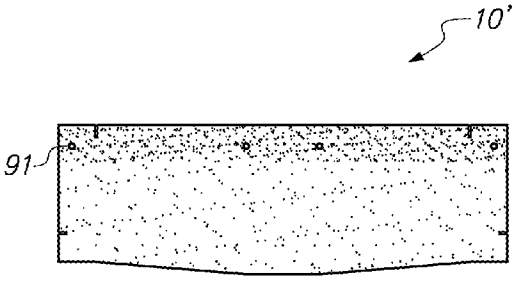
FIG. 9 shows a top plan view of a second exemplary embodiment of the roofing shingle of the present invention, and further illustrating the placement of roofing nails used to install the shingle.
Figure 11:
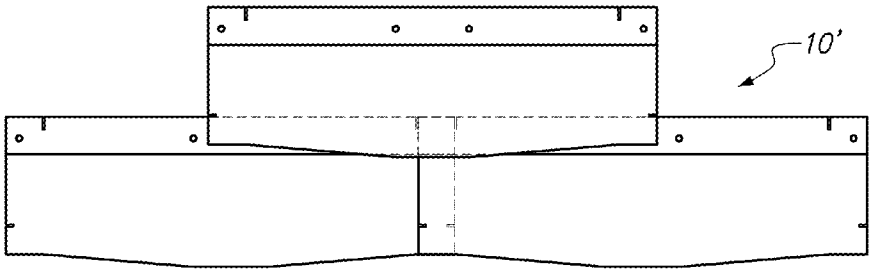
Figure 12:
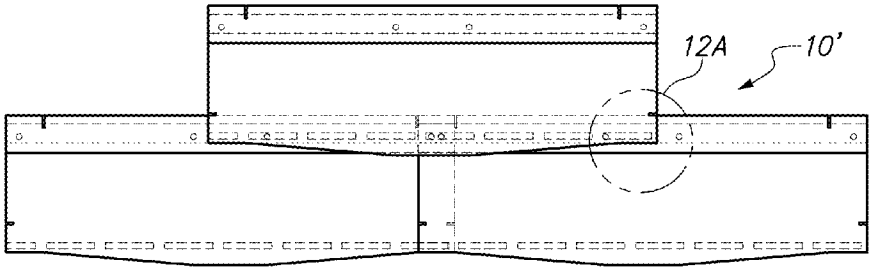
Figure 13:
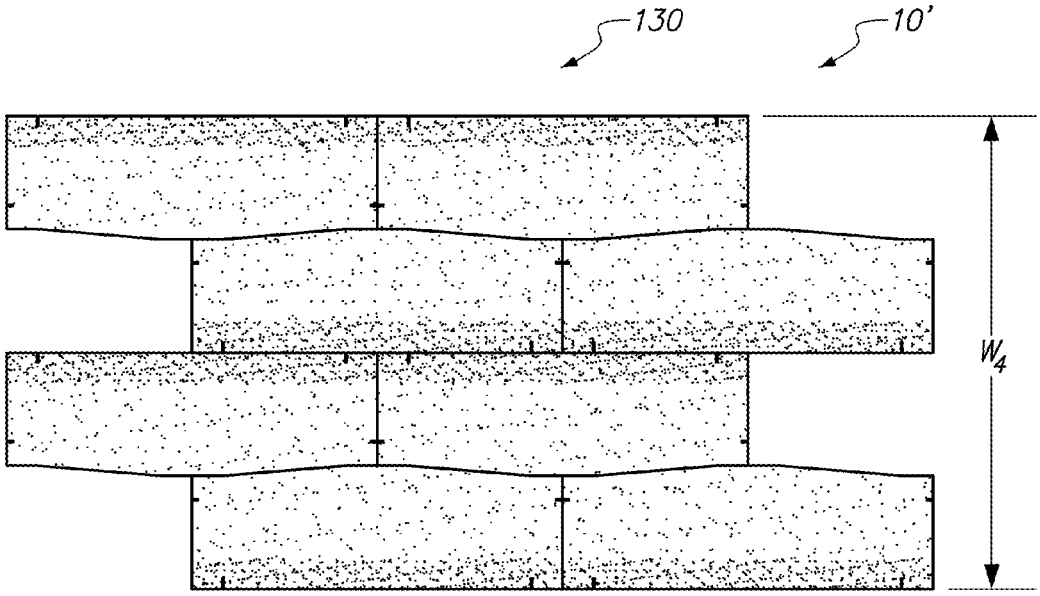
Figure 14:
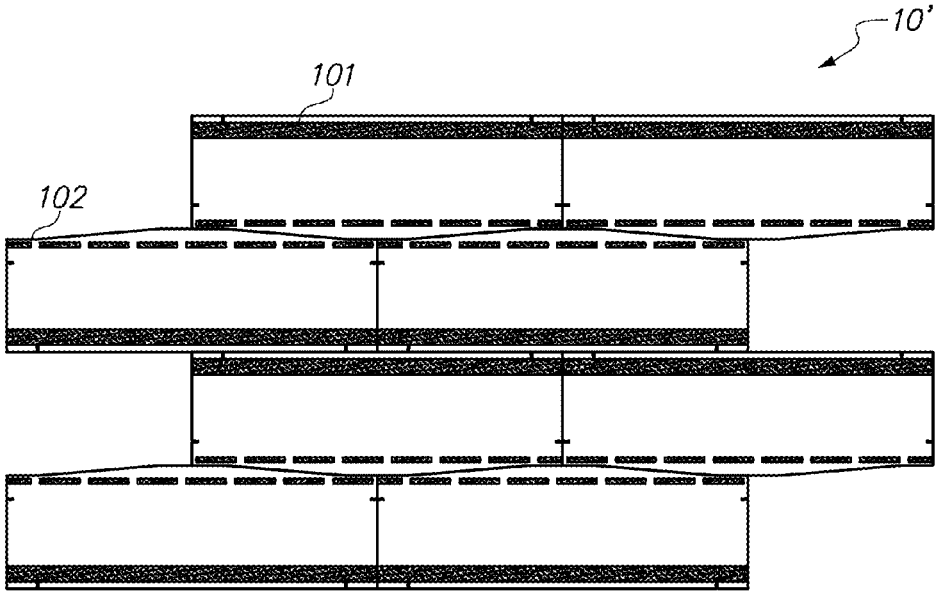
Figure 15:
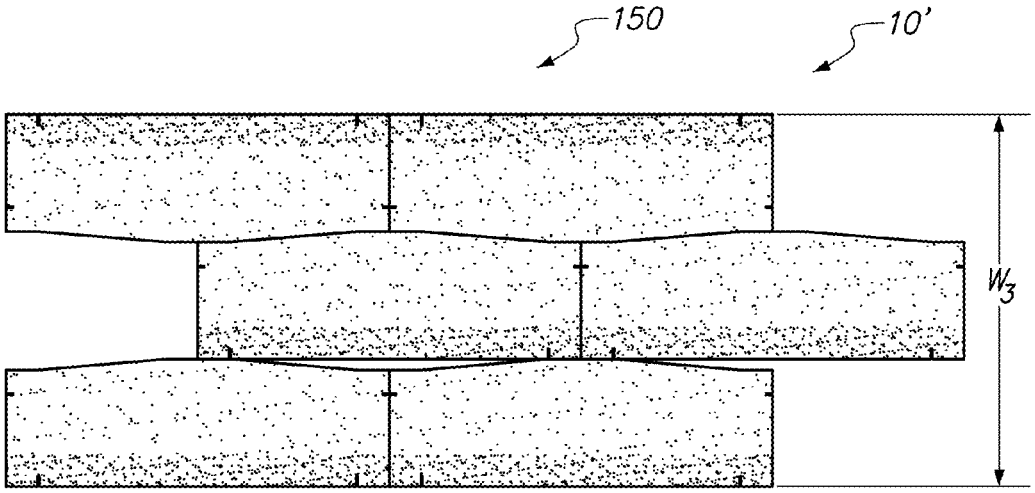
Figure 16:
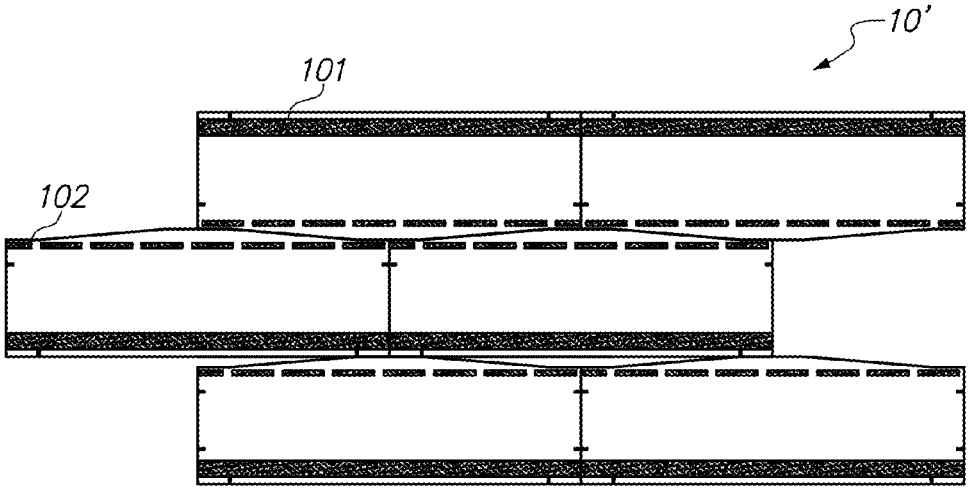
Figure 17:
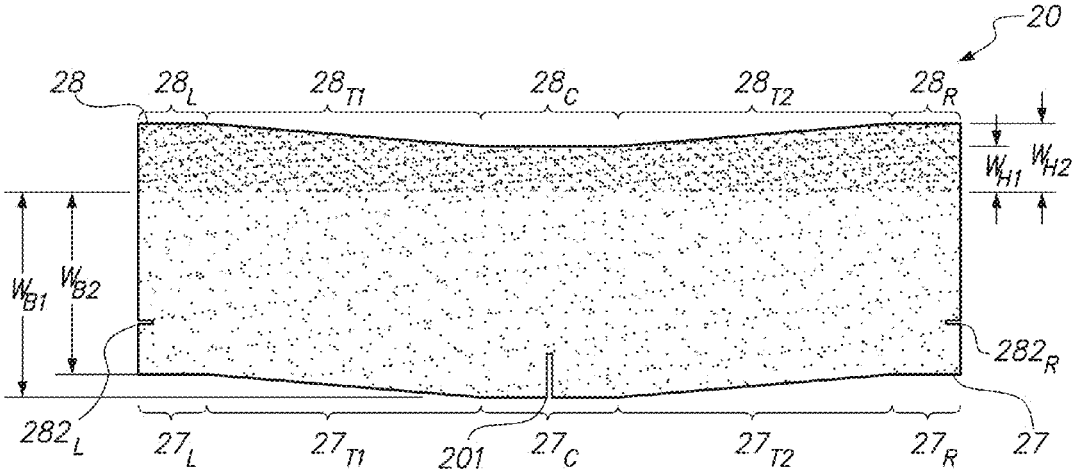
Figure 18:
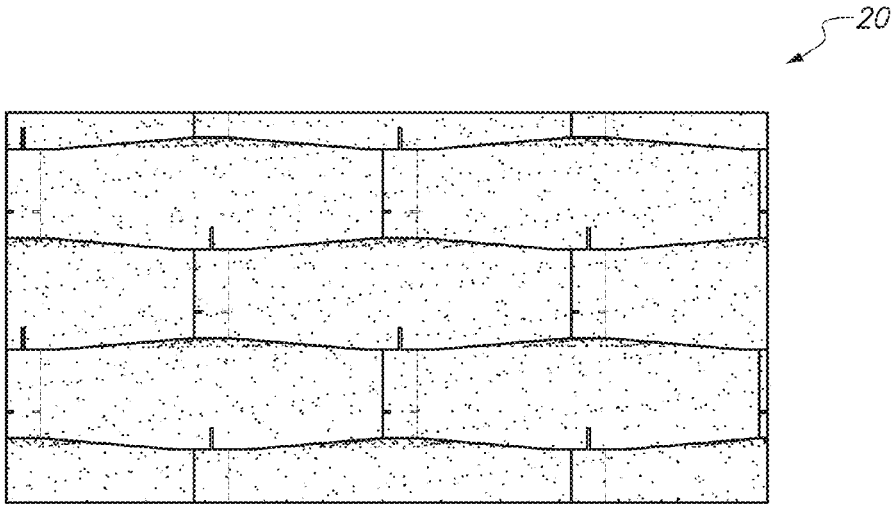
Figure 19:
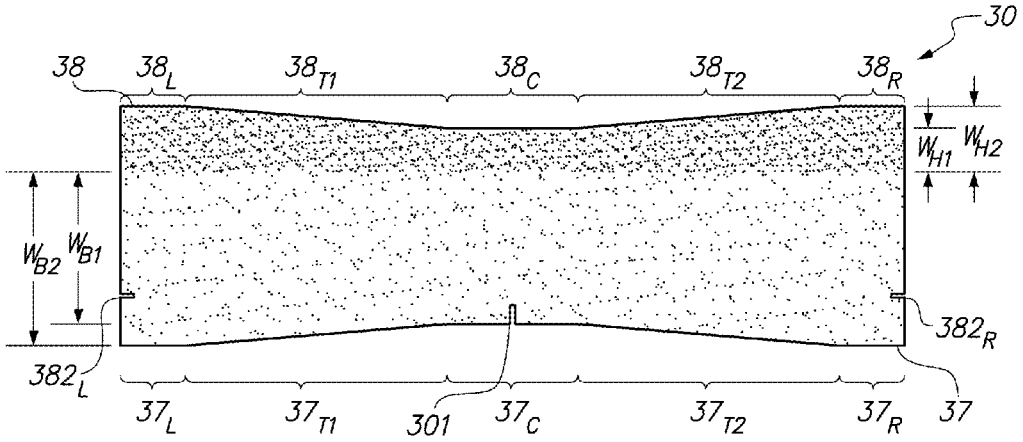
Figure 20:
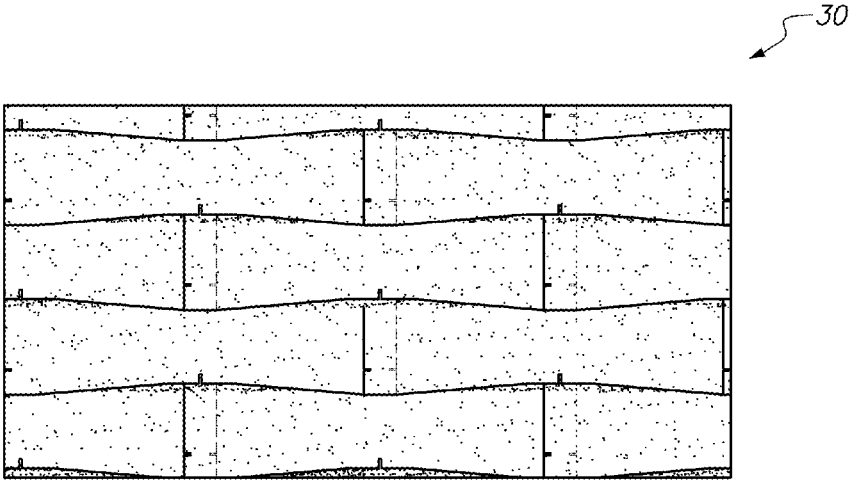

FIG. 10 a bottom plan view of the exemplary embodiment of the roofing shingle of the present invention depicted in FIG. 9;

FIG. 11 shows a top plan view of an exemplary embodiment of a roofing system of the present invention incorporating the exemplary embodiment of the roofing shingle of the present invention depicted in FIG. 9, and further illustrating the placement of roofing nails used to install the shingle;

FIG. 12 shows a top plan view of an exemplary embodiment of a roofing system of the present invention incorporating the exemplary embodiment of the roofing shingle of the present invention depicted in FIG. 9, illustrating overlapped portions of the shingles and placement of features on the bottom portion of the shingles shown in broken lines, and further illustrating the placement of roofing nails used to install the shingle;

FIG. 12A shows an exploded view of a portion of the top plan view of the exemplary embodiment of the roofing system of the present invention depicted in FIG. 12;

FIG. 13 shows a top plan view of an exemplary sheet of roofing material of the present invention from which four shingles of FIG. 9 may be obtained;

FIG. 14 shows a bottom plan view of an exemplary sheet of roofing material of the present invention from which four shingles of FIG. 9 may be obtained;

FIG. 15 shows a top plan view of an exemplary sheet of roofing material of the present invention from which three shingles of FIG. 9 may be obtained;

FIG. 16 shows a bottom plan view of an exemplary sheet of roofing material of the present invention from which three shingles of FIG. 9 may be obtained;

FIG. 17 shows a top plan view of a third exemplary embodiment of the roofing shingle of the present invention;

FIG. 18 shows a top plan view of an exemplary embodiment of a roofing system of the present invention incorporating the exemplary embodiment of the roofing shingle of the present invention depicted in FIG. 17;

FIG. 19 shows a top plan view of a fourth exemplary embodiment of the roofing shingle of the present invention;

FIG. 20 shows a top plan view of an exemplary embodiment of a roofing system of the present invention incorporating the exemplary embodiment of the roofing shingle of the present invention depicted in FIG. 19.

DETAILED DESCRIPTION

The preferred embodiments of the present invention and its advantages are best understood by referring to non-limiting FIGS. 1 through 20, like numerals being used for like and corresponding parts of the various drawings. Reference to the figures herein is not intended to limit the scope of the invention, but allows further description of the invention through exemplary embodiments.

The first embodiment of the present invention, which relates to a roofing system comprising single-layer shingles having a non-straight longitudinal front edge that, when installed in a side-lap (or shiplap) fashion, enables an increase in shingle exposure, will now be described in greater detail by referring to the drawings that accompany the present application.

Figure 1:
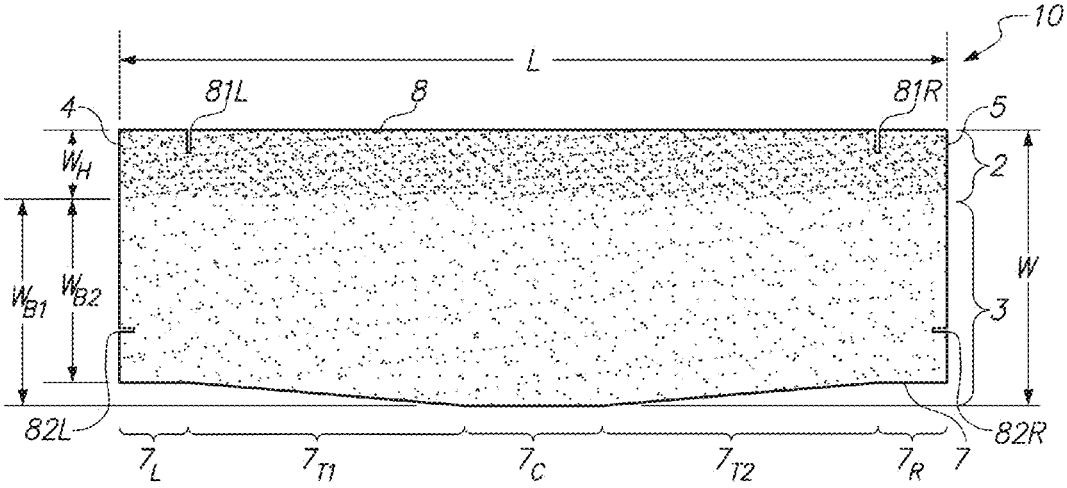
FIG. 1 shows a top plan view of an exemplary embodiment of a roofing shingle of the present invention.
Figure 2:
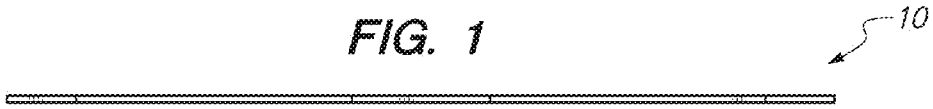
FIG. 2 shows a front elevation view of the exemplary embodiment of the roofing shingle of the present invention depicted in FIG. 1.
Figure 3:
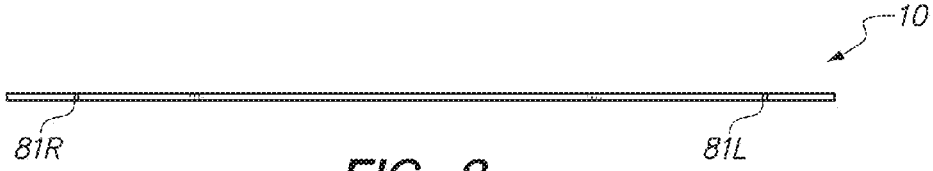
FIG. 3 shows a rear elevation view of the exemplary embodiment of the roofing shingle of the present invention depicted in FIG. 1.
Figure 4:
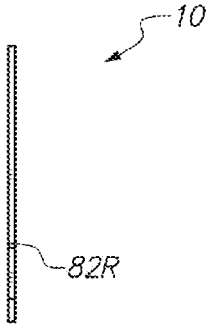
FIG. 4 shows a right side view of the exemplary embodiment of the roofing shingle of the present invention depicted in FIG. 1.
Figure 5:
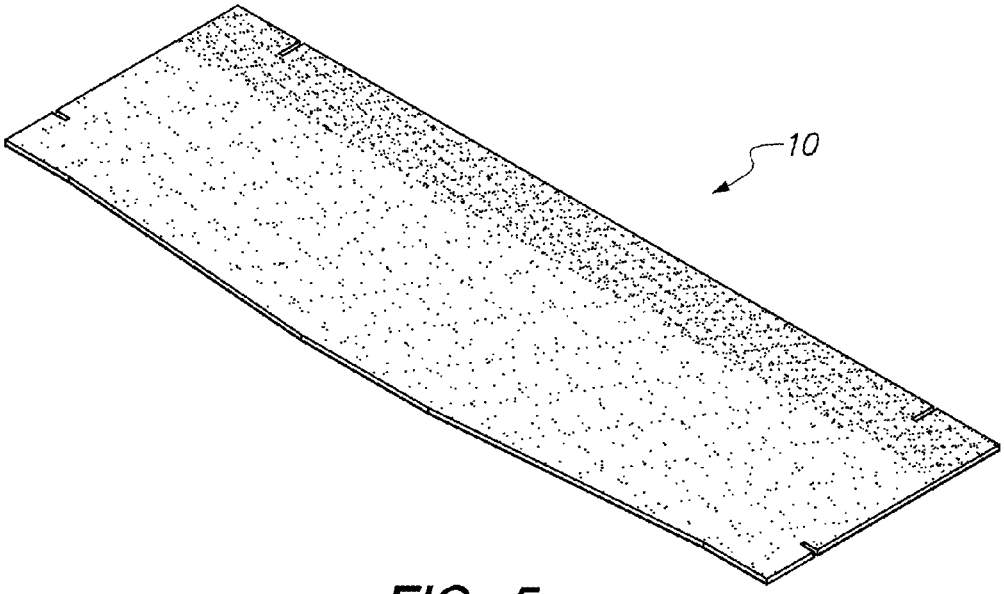
FIG. 5 shows a perspective view of the exemplary embodiment of the roofing shingle of the present invention depicted in FIG. 1.
Figure 6:
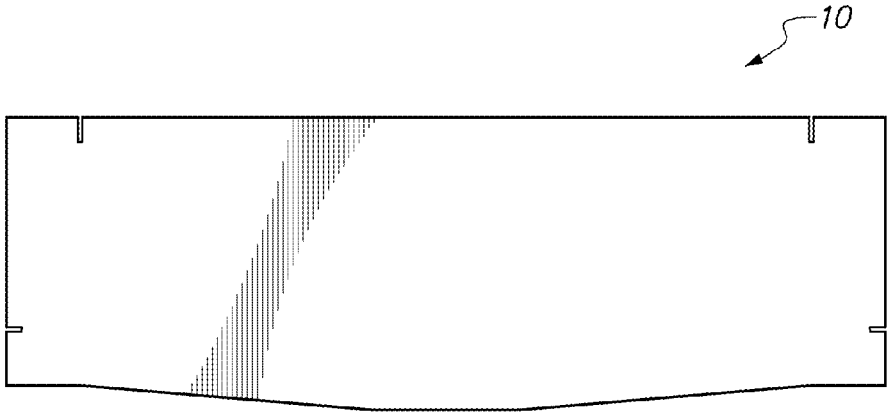
FIG. 6 shows a bottom plan view of the exemplary embodiment of the roofing shingle of the present invention depicted in FIG. 1.
Figure 7:
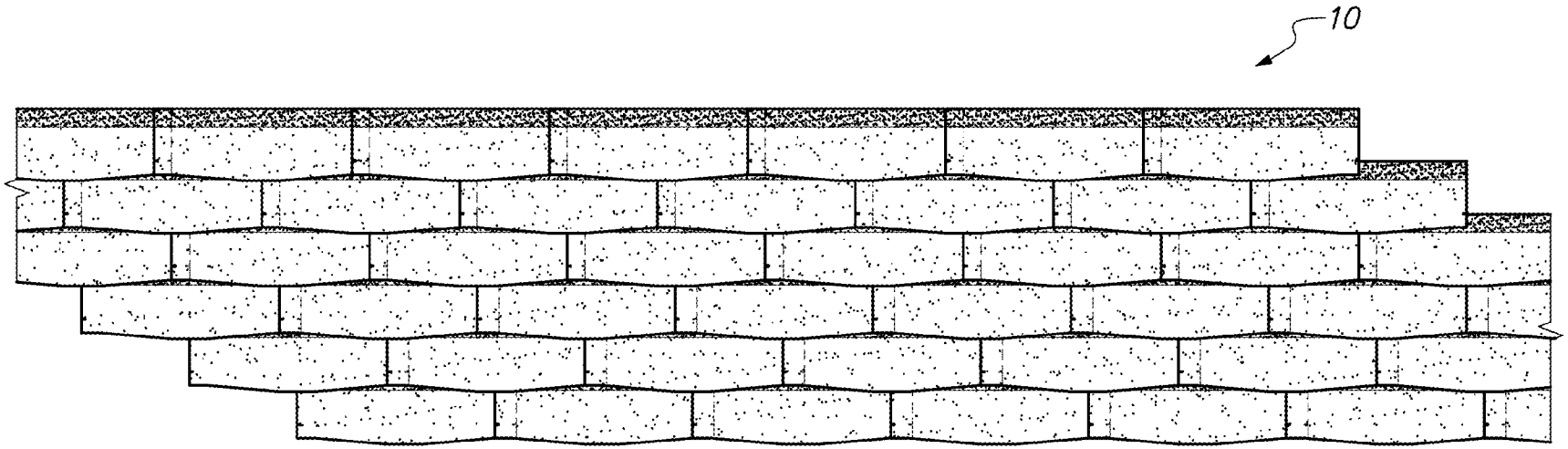
FIG. 7 shows a top plan view of an exemplary embodiment of a roofing system of the present invention incorporating the exemplary embodiment of the roofing shingle of the present invention depicted in FIG. 1.
Figure 8:
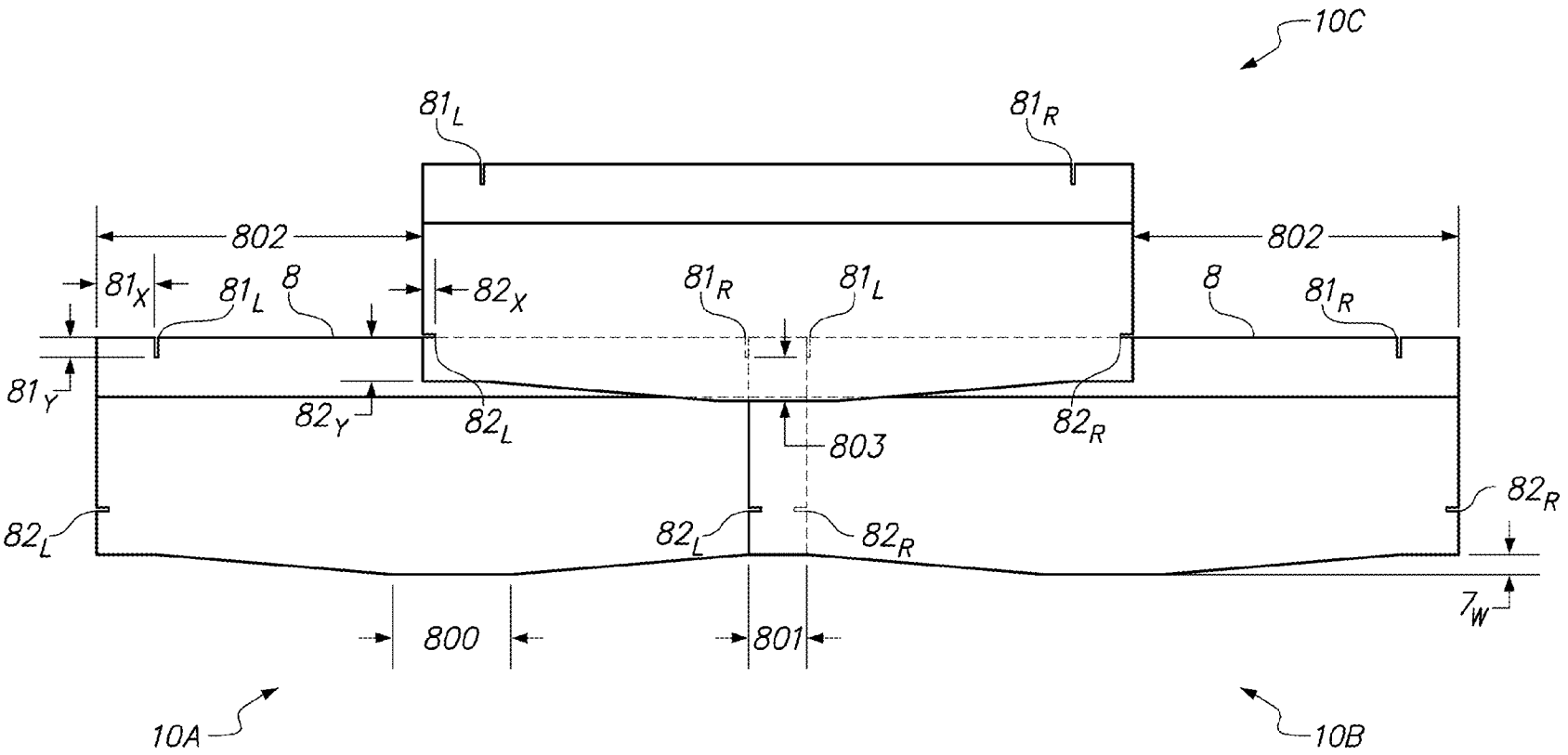
FIG. 8 shows a top plan view of an exemplary embodiment of a roofing system of the present invention incorporating the exemplary embodiment of the roofing shingle of the present invention depicted in FIG. 1, illustrating overlapped portions of the shingles in broken lines.

A shingle 10 incorporating one embodiment of the present invention is shown in FIGS. 1-8. FIG. 1 illustrates a top plan view of shingle 10. Shingle 10 has a width (w) and a length (l). Shingle 10 comprises a headlap portion 2, a buttlap portion 3, a non-straight longitudinal front edge 7, a longitudinal rear edge 8, a lateral leading edge 5, and a lateral trailing edge 4. When installed on a roof deck, as illustrated in FIG. 7 and with continued reference to FIG. 1, the headlap portion 2 of a previously installed shingle 10 is covered by a portion of the buttlap portion 3 of a subsequently installed shingle 10 and, as illustrated in FIG. 8 and with continued reference to FIG. 1, the trailing edge 4 of subsequently installed shingle 10B overlaps (i.e., side-laps) a portion of a previously installed shingle 10A.

Referring back to FIG. 1, the non-straight longitudinal front edge 7 has a central horizontal portion $\mathbf{7}_C$, a left horizontal portion $\mathbf{7}_L$, a right horizontal portion $\mathbf{7}_R$, a first transition portion $\mathbf{7}_{T1}$, and a second transition portion $\mathbf{7}_{T2}$. The central horizontal portion $\mathbf{7}_C$ extends away from the shingle to define a first buttlap width $W_{B1}$ and the left horizontal portion $\mathbf{7}_L$ and right horizontal portion $\mathbf{7}_R$ each extends away from the shingle to define a second buttlap width $W_{B2}$. The first transition portion $\mathbf{7}_{T1}$ is situated between the central horizontal portion $\mathbf{7}_C$ and the left horizontal portion $\mathbf{7}_L$, and the second transition portion $\mathbf{7}_{T2}$ is situated between the central horizontal portion $\mathbf{7}_C$ and the right horizontal portion $\mathbf{7}_R$.

Preferably, the first buttlap width may be between 3 and 10 inches, more preferably between 7¼ and 9½ inches, and even more preferably about 9 inches. In another embodiment, the first buttlap width is preferably about 8¾ inches, see, e.g., FIG. 17, shingle 20, $W_{B1}$. In yet another embodiment, the first buttlap width is preferably about 7¾ inches, see, e.g., FIG. 19, shingle 30, $W_{B1}$.

Preferably, the second buttlap width may be between 4¾ and 11¾ inches, more preferably between 7¼ and 9¼ inches, and more preferably about 8 inches. In another embodiment, the second buttlap width is preferably about 7¾ inches, see, e.g., FIG. 17, shingle 20, $W_{B2}$. In yet another embodiment, the second buttlap width is preferably about 8¾ inches, see, e.g., FIG. 19, shingle 30, $W_{B2}$.

Preferably, the difference between the first buttlap width and the second buttlap width may be between ½ and 3½ inches, and more preferably about 1 inch.

Referring back to FIG. 1, it will be appreciated that the width of the buttlap varies across the first transition portion $\mathbf{7}_{T1}$ and the second transition portion $\mathbf{7}_{T2}$, wherein the width may be between the first buttlap width $W_{B1}$ and the second buttlap width $W_{B2}$.

With continued reference to FIG. 1, shingle 10 has a maximum buttlap width (the first buttlap width $W_{B1}$) and a maximum headlap width ($W_H$) that is less than the maximum buttlap width, which defines a reduced-width headlap. Preferably, the maximum headlap width may be between 20% and 100% of the maximum buttlap width. In a preferred embodiment, the maximum headlap width is less than 50% the maximum buttlap width. In a particularly preferred embodiment, the maximum headlap width is about 33% the maximum buttlap width.

As depicted in FIGS. 1-8, shingle 10 has a straight longitudinal rear edge 8 and the headlap has a uniform headlap width $W_H$ that is also the maximum headlap width. Preferably, the headlap width may be between 2 and 6 inches, and more preferably between 2½ and 4½ inches, and even more preferably about 3 inches. However, the longitudinal rear edge of the shingle of the invention may be non-straight.

Referring to FIGS. 17-20, in other preferred embodiments, shingles 20, 30 of the invention may have a non-straight longitudinal rear edge 28, 38, respectively, that have a central horizontal portion $\mathbf{28}_C$, $\mathbf{38}_C$, a left horizontal portion $\mathbf{28}_L$, $\mathbf{38}_L$, a right horizontal portion $\mathbf{28}_R$, $\mathbf{38}_R$, a first transition portion $\mathbf{28}_{T1}$, $\mathbf{38}_{T1}$, and a second transition portion $\mathbf{28}_{T2}$, $\mathbf{38}_{T2}$. The central horizontal portion $\mathbf{28}_C$, $\mathbf{38}_C$, extends away from the shingle to define a first headlap width $W_{H1}$ and the left horizontal portion $\mathbf{28}_L$, $\mathbf{38}_L$ and right horizontal portion $\mathbf{28}_R$, $\mathbf{38}_R$ each extends away from the shingle to define a second headlap width $W_{H2}$. The first transition portion $\mathbf{28}_{T1}$, $\mathbf{38}_{T1}$ is situated between the central horizontal portion $\mathbf{28}_C$, $\mathbf{38}_C$ and the left horizontal portion $\mathbf{28}_L$, $\mathbf{38}_L$, and the second transition portion $\mathbf{28}_{T2}$, $\mathbf{38}_{T2}$ is situated between the central horizontal portion $\mathbf{28}_C$, $\mathbf{38}_C$ and the right horizontal portion $\mathbf{28}_R$, $\mathbf{38}_R$.

Preferably, the first headlap width may be between 2 and 5 inches, more preferably between 2½ and 3½ inches, and even more preferably about 3 inches. Preferably, the second headlap width may be between 1 and 6 inches, more preferably between 3½ and 4½ inches, and even more preferably about 4 inches. As depicted in FIGS. 17-20, shingles 20 and 30 may have a first headlap width $W_{H1}$ that is less than the second headlap width $W_{H2}$, i.e., the maximum headlap is $W_{H2}$. However, it is contemplated that the first headlap width may be greater than the second headlap width (not shown).

Preferably, the difference between the first headlap width and the second headlap width may be between ½ and 3½ inches, and more preferably about 1 inch. It will be appreciated that the width of the headlap varies across the first transition portion and the second transition portion, wherein the width may be between the first headlap width and the second headlap width.

Referring to FIGS. 19 and 20, shingle 30 of the invention may have a non-straight longitudinal front edge 37, wherein the maximum buttlap width is $W_{B2}$, i.e., located at the left horizontal portion $\mathbf{37}_L$ and the right horizontal portion $\mathbf{37}_R$.

As depicted in FIGS. 1-20, shingles 10, 10', 20, and 30 of the invention may have a headlap portion 2 that is surfaced with a first shade of granules and a buttlap portion 3 that is surfaced with a second shade of granules. However, it is contemplated that the headlap portion and buttlap portion may be surfaced with the same shade of granules. Furthermore, it is contemplated that the buttlap portion may be surfaced with a blend of at least two different shades of granules, e.g., from light to dark or dark to light.

The shingles of the invention may further comprise an alignment means. Referring to FIGS. 1-8, shingles 10 of the invention may have a first and second alignment notch from a first set of alignment notches 82L and 82R, respectively, situated on the lateral trailing edge 4 and the lateral leading edge 5, respectively. When installed on a roof deck, as illustrated in FIG. 8, the first and second alignment notches from the first set of alignment notches 82L and 82R, respectively, of a shingle 10C in a subsequently installed course of shingles align with the longitudinal rear edge 8 of shingles 10A and 10B in a previously installed course of shingles. Similarly, referring to FIGS. 17 and 19, shingles 20 and 30 may have a first and second alignment notch from a first set of alignment notches 282L, 282R and 382L, 382R that when installed align with the longitudinal rear edges 28 and 38 of shingles 20 and 30, respectively, in a previously installed course of shingles.

Referring to FIG. 8, preferably, the first and second alignment notch from the first set of alignment notches 82L and 82R, respectively, are each positioned about the same distance, a first overlap distance 82*y*, from the longitudinal front edge 7 and may have the same cut length 82*x*. Preferably, the first overlap distance may be between 2 and 5 inches, and more preferably about 2¼ inches. Preferably, the cut length of the first and second alignment notch from the first set of alignment notches may be between ¼ and 1 inches, and more preferably about ½ inches.

Referring back to FIG. 8, the first and second alignment notch from the first set of alignment notches 82L and 82R, respectively, and the non-straight longitudinal front edge 7 of shingle 10C operate to provide a second overlap distance 803, wherein the buttlap 3 of shingle 10C provides sufficient material coverage over the side-lap region between shingles 10A and 10B and a first and second alignment notch from a second set of alignment notches 81R and 81L of shingles 10A and 10B, respectively. Preferably, the second overlap distance may be between 2 and 5 inches, and more preferably about 2¼ inches. The second overlap distance should be sufficient to provide leak protection at the side-lap region and especially at the first and second alignment notches from the second set of alignment notches of the shingles in the previously installed course. Preferably, the second overlap distance extends over a portion of the buttlap portions of the inventive shingles.

Referring to FIGS. 7 and 8, it will be appreciated that the non-straight longitudinal front edges 7 of shingles 10 in a subsequently installed course create a continuous profile that undulates across the length of the shingle course by extending over the side-lap regions of shingles 10 in a previously installed course and receding to expose a portion of the headlap portions 2 of shingles 10 in the previously installed course. The continuous undulating front edge profile of the installed shingles provides an improved aesthetic appearance. In preferred embodiments that have granules of contrasting color on the headlap portion, the aesthetic appearance of the shingles is further enhanced by creating the appearance of depth, see, e.g., FIG. 7. It will further be appreciated that the aforementioned alignment means may help the installer maintain a consistent pattern of exposed headlap portions and a uniform undulating front edge profile along adjacently installed shingle courses during installation.

Referring to FIGS. 1 and 8, shingles 10 of the invention may also have a second set of first and second alignment notches 81R and 81L, respectively, situated on the longitudinal rear edge 8. When installed on a roof deck, as illustrated in FIG. 8 and with continued reference to FIG. 1, the lateral trailing edge 4 (i.e., the left lateral edge of shingle 10 in this system embodiment) of subsequently installed shingle 10B aligns with a first alignment notch from the second set of alignment notches 81R of previously installed shingle 10A in the same course. It will also be appreciated that the front edge of left horizontal portion $\mathbf{7}_L$ of shingle 10B aligns with the front edge of the right horizontal portion $\mathbf{7}_R$ of shingle 10A. As depicted in FIG. 8, shingles 10A and 10B are installed in a left to right manner. It will be further appreciated that the shingles of the invention can be installed in a right to left manner and the second alignment notch from the second set of alignment notches 81L would align with the right-side oriented lateral trailing edge (not shown).

Preferably, the first and second alignment notches from the second set of alignment notches 81L and 81R, respectively, are each positioned about the same distance, side-lap distance 81*x*, from the nearest lateral edge of shingle 10 and may have the same cut length 81*y*. Preferably, the side-lap distance may be between 2 and 9 inches, and more preferably about 3 inches or 5 inches. Preferably, the cut length of the first and second alignment notch from the second set of alignment notches may be between ¼ and 1½ inches, and more preferably about 1 inch.

Referring to FIG. 8, preferably, side-lap distance 81*x* is about the same as the breadth 801 of the side-lap region (and the breadth of left horizontal portion and the right horizontal portion, see FIG. 1, shingle 10, $\mathbf{7}_L$ and $\mathbf{7}_R$, respectively). Preferably, the breadth 800 of the central horizontal portion $\mathbf{7}_C$ is about twice the breadth 801 of the side-lap region. Preferably, shingle 10C is centrally positioned over shingles 10A and 10B, such that the distance 802 between the lateral edges of overlapped shingles is the same on the left and right sides of shingle 10C.

With continued reference to FIG. 8, in a particularly preferred embodiment, the breadth 801 of the side-lap region is about 3 inches, and the distance between the non-straight longitudinal front edge 7 of a shingle 10C in a subsequently installed course and the longitudinal rear edge 8 and the first and second alignment notches from the second set of alignment notches 81L, 81R of shingles 10A, 10B in a previously installed course is at least 2¼ inches.

Referring to FIGS. 19 and 20, in another preferred embodiment, shingles 30 of the invention may be installed on a roof deck, wherein the non-straight longitudinal front edges 38 of shingles 30 in a subsequently installed course create a continuous profile that undulates across the length of the shingle course, but instead of the continuous profile extending over the side-lap regions of shingles in a previously installed course (see, e.g., FIGS. 7 and 8, shingles 10) the continuous profiles extend over the longitudinal center of shingle 30 in a previously installed course and recede to expose a portion of the side-lapped headlap portions of shingles 30 in the previously installed course.

As depicted in FIGS. 1-8, shingle 10 of the invention may have an undivided buttlap portion 3, i.e., the buttlap portion 3 is free of slots separating tabs. However, as depicted in FIGS.

17-20, shingles 20, 30 of the invention may have a tabbed buttlap portion 3, i.e., the buttlap portion 3 of shingles 20, 30 may include longitudinal front edge slot openings 201, 301, respectively. Referring to FIGS. 17 and 18, preferably the longitudinal front edge slot opening 201 may be between 0 and 4 inches, and more preferably about 2 inches. Referring to FIGS. 19 and 20, preferably the longitudinal front edge slot opening 301 may be between 0 and 2 inches, and more preferably about 1 inches. Preferably, the longitudinal front edge slot openings have a breadth between ¼ and 1 inches, and more preferably about ⅜ inches. Referring to FIGS. 17-20, when installed, subsequently installed shingles 20, 30 should have sufficient material from shingles 20, 30 in a previously installed course underneath the longitudinal front edge slot openings 201, 301 to provide sufficient leak protection under the longitudinal front edge slot openings 201, 301. For example, the longitudinal front edge slot openings should be surrounded by at least 2 inches of overlapped material, preferably by at least 2¼ inches of overlapped material. Although the embodiments depicted in FIGS. 17-20 have a single slot opening located at the longitudinal center of the shingle, multiple slot openings and other slot opening placements are contemplated. Furthermore, shingles without slot openings are contemplated.

Referring to FIGS. 10, 12, 12A, shingles 10' of the invention may further comprise sealant strips 102 situated on the bottom of shingle 10' in a straight line near the non-straight longitudinal front edge 7. The straight line of sealant strips 102 may be positioned at a sealant placement distance $102_{y1}$ from the front edge of a horizontal portion of the non-straight longitudinal edge 7 (e.g., the left horizontal portion $7_L$ and the right horizontal portion $7_R$). Preferably, the sealant placement distance may be between 0 and 1 inches, more preferably about 11/16 inches. When shingles 10' are installed, it will be appreciated that only a minor portion of the buttlap portion 3 extends beyond the sealant strips 102. In this embodiment, the placement of the sealant strips 102 and the shape of the non-straight longitudinal front edge 7 provide a shingle that has a front edge that is nearly uniformly sealed to the roof deck or shingles in a previously installed course.

Shingle 10' may also comprise a release tape 101 situated on the bottom of shingle 10' near the longitudinal rear edge 8. Shingles 10' may be packaged in a complementary fashion (oriented 180° in relation to one another) such that the bottom surfaces of two shingles 10' face each other, wherein the sealant strips 102 of a first shingle 10' communicate with the release tape 101 of a second shingle 10' (not shown). It is contemplated that the release tape may add additional reinforcement at the nail zone. It will be appreciated that FIGS. 9-12A depict desirable locations for nail placement 91 upon installation.

In another embodiment, the sealant strips 102 may be situated on the topside of shingle 10' in the headlap portion 3 (not shown). In this embodiment, the sealant strips may serve as an alignment means for adjacently installed shingles in the same course (not shown) and an alignment means for subsequently installed shingles in a subsequent course (not shown).

For one embodiment of the present invention, the shingle 10 may be formed from a fiberglass mat (not shown) with an asphalt coating on both sides of the mat. If desired, the present invention may also be used with shingles formed from organic felt or other types of base material, including but not limited to synthetic mats or synthetic glass/hybrid mats having an appropriate coating. Nonlimiting embodiments of coatings include asphalt and modified bituminous coatings based on atactic polypropylene (APP), styrene-butadiene-styrene (SBS), styrene-ethylene-butadiene-styrene (SEBS), amorphous polyalpha olefin (APAO), thermoplastic polyolefin (TPO), synthetic rubber, their combinations, or other asphaltic modifiers.

Referring to FIG. 1, the exposed outer surface or weather surface, i.e., the buttlap portion 3 and portions of the headlap portion 2 of shingle 10 of the invention, may be coated with various types of mineral granules to protect the asphalt coating, to add color to shingle 10 of the invention and to provide fire resistance. For some applications, ceramic-coated mineral granules may be disposed on the top surface of the buttlap portion. Also, a wide range of mineral colors from white and black to various shades of red, green, brown and any combination thereof may be used to provide a roof having the desired color for the shingle of the invention. In preferred embodiments, the headlap portion of the shingle of the invention may be coated with coatings that contrast with coatings applied to the buttlap portion of the shingle of the invention. In other embodiments, the entire outer surface of shingle 10 of the invention may be coated with any of the aforementioned coatings. The underside of shingle 10 of the invention may be coated with various inert minerals with sufficient consistency to seal the asphalt coating.

An important feature of the present invention includes providing a shingle having a reduced-width headlap portion. For the embodiment of the present invention shown in FIGS. 1-8, headlap portion 2 has a maximum headlap width ($W_H$) that is about 33% of the maximum buttlap width ($W_{B1}$) of shingle 10 of the invention. However, as noted above, the headlap portion may have a width that is 20% to 100% of the maximum buttlap width of the shingle of the invention.

Another important feature of the present invention includes providing a shingle with a non-straight longitudinal front edge. The shape and dimensions of the shingles of the invention operate to provide sufficient weather protection, i.e., by providing side-lap regions between adjacently installed shingles in the same course and sufficient overlap (e.g., at least 2¼ inches) between shingles in a previously installed course and shingles in a subsequently installed course, while maximizing the weather exposure of each shingle. The increased exposure of each shingle allows for an overall reduction in materials necessary to cover a roof deck.

In a preferred embodiment, the exposure of the installed shingles of the invention may be between 64% and 86% of the total surface area of the shingle, more preferably between 67% and 76%. In a particularly preferred embodiment, the exposure may be approximately 70% of the shingle. In another particularly preferred embodiment, the exposure may be approximately 73%. For the embodiments of the invention with an exposure of approximately 70%, approximately 143 $ft^2$ of roofing material is needed to cover 100 $ft^2$ of a roof deck. For the embodiments of the invention with an exposure of approximately 73%, approximately 137 $ft^2$ of roofing material is needed to cover 100 $ft^2$ of a roof deck.

The reduced-width headlap portion and the unique shape and/or dimensions of the shingle of the present invention are desirable because they allow for an improved utilization of materials that are required to make the shingles. In preferred embodiments of this invention, the shingles and roof system of the present invention improve the material utilization over traditional, prior art 3-tab shingles preferably by between 35% and 52%, and more preferably by 40% (approximately 143 $ft^2$ of material needed for 100 $ft^2$ of coverage using shingles according to the instant invention versus 240 $ft^2$ of material for traditional, prior art 3-tab shingles). In another preferred embodiment, the improved material utilization over traditional, prior art 3-tab shingles may preferably be 43% (approximately 137 $ft^2$ of material needed for 100 $ft^2$ of coverage using shingles according to the instant invention versus 240 $ft^2$ of material for traditional, prior art 3-tab shingles).

The non-straight longitudinal front edge of the shingle of the present invention is desirable because it improves the aesthetics of the shingle when installed. The aesthetics of the shingle may further be enhanced, e.g., in a preferred embodiment, by surfacing the headlap portion with a first shade of granules that contrasts with a second shade of granules that surface the buttlap portion. In this embodiment, the contrasting colors of the exposed headlap portion and the buttlap portion, along with the non-straight longitudinal front edge of the shingles of the present invention, may create a perceived increase in shingle depth.

A non-limiting example of a method of manufacturing the shingles of the invention will now be described. FIG. 13 shows a sheet of roofing material 130 from which shingles 10' of the invention are formed. FIG. 13 depicts a format known as a "4-wide" format, wherein four shingles are formed across a sheet of roofing material 130. The roofing material 130 has a width $W_4$ and an indeterminate length. The roofing material is fed through processing assemblies, wherein the roofing material may be surfaced with granules, and further fed through cutting assemblies, wherein the shapes and/or features of the individual shingles are formed. Typically, to make prior art strip shingles having a width of about 12 inches using a 4-wide format, the roofing material has a width of about 48 inches. However, in a preferred embodiment of the invention, to make the shingles of the invention having a width (w) of about 12 inches using a 4-wide format, the roofing material has a width of about 46 inches.

Referring to FIG. 15, another known format for making strip shingles is the "3-wide" format, wherein three shingles are formed across a sheet of roofing material 150. Typically, to make prior art strip shingles having a width of about 12 inches using a 3-wide format, the roofing material has a width of about 36 inches. However, in a preferred embodiment of the invention, to make the shingles of the invention having a width (w) of about 12 inches using a 3-wide format, the roofing material has a width of about 35 inches.

FIGS. 14 and 16 depict the underside of roofing materials 130 and 150, respectively, and illustrate the placement of the sealant strips 102 and the release tape 101.

The above-described methods of making the shingles of the invention may be employed at current strip shingle plants with little mechanical changes to the plants.

Although the present invention and its advantages have been described in detail, it should be understood that various changes, substitutions and alterations can be made therein without departing from the spirit and scope of the invention as defined by the appended claims.

What is claimed is:

1. A roofing system comprising:

single-layer shingles having a headlap portion; and a buttlap portion;

wherein said headlap portion has a maximum headlap width that is less than a maximum buttlap width of said buttlap portion;

wherein said buttlap portion includes a longitudinal rear edge, a lateral leading edge, a lateral trailing edge, and a non-straight longitudinal front-most edge having a central horizontal portion, a left horizontal portion, a right horizontal portion, a first transition portion, and a second transition portion, wherein the central horizontal portion extends away from the shingle to define a first buttlap width, the left horizontal portion is connected between the lateral trailing edge and the first transition portion, the right horizontal portion is connected between the lateral leading edge and the second transition portion, and the left horizontal portion and the right horizontal portion each extends away from the shingle to define a second buttlap width, and wherein the first transition portion is further connected between the left horizontal portion and the central horizontal portion and the second transition portion is further connected between the central horizontal portion and the right horizontal portion;

wherein the roofing system comprises a plurality of courses of said shingles, and wherein a trailing lateral edge of a subsequently installed shingle in a first course of shingles overlaps a leading lateral edge of a horizontally adjacent previously installed shingle in the first course to provide a side-lap region; and wherein said buttlap portion includes an exposed buttlap portion, and wherein the exposed buttlap portion has a surface area that is greater than the surface area of said headlap portion.

2. The roofing system according to claim 1, wherein said headlap portion is surfaced with a first shade of granules and said buttlap portion is surfaced with a second shade of granules.

3. The roofing system according to claim 1, wherein said headlap portion includes an exposed headlap portion.

4. The roofing system according to claim 1, wherein the maximum headlap width is less than 50% the maximum buttlap width.

5. The roofing system according to claim 4, wherein the maximum headlap width is about 33% the maximum buttlap width.

6. The roofing system according to claim 1, wherein the first buttlap width is the maximum buttlap width.

7. The roofing system according to claim 6, wherein the first buttlap width is about 1" greater than the second buttlap width.

8. The roofing system according to claim 1, wherein the second buttlap width is the maximum buttlap width.

9. The roofing system according to claim 8, wherein the first buttlap width is about 1" less than the second buttlap width.

10. The roofing system according to claim 1, wherein said headlap portion includes a non-straight longitudinal rear edge having a central horizontal portion, a left horizontal portion, a right horizontal portion, a first transition portion, and a second transition portion, wherein the central horizontal portion extends away from the shingle to define a first headlap width, the left horizontal portion and right horizontal portion each extends away from the shingle to define a second headlap width, and wherein the first transition portion is situated between the left horizontal portion and the central horizontal portion and the second transition portion is situated between the central horizontal portion and the right horizontal portion.

11. The roofing system according to claim 10, wherein the second headlap width is the maximum buttlap width.

12. The roofing system according to claim 11, wherein the first headlap width is about 1" less than the second headlap width.

13. The roofing system according to claim 6, wherein said shingles further comprise a first set of alignment notches, wherein a first alignment notch from the first set of alignment notches is situated on the trailing lateral edge of a subsequently installed shingle in a subsequent course of shingles and lines up with a longitudinal rear edge of the headlap portion of a previously installed shingle in the first course of shingles.

14. The roofing system according to claim 8, wherein said shingles further comprise a first set of alignment notches, wherein a first alignment notch from the first set of alignment notches is situated on the trailing lateral edge of a subsequently installed shingle in a subsequent course of shingles and lines up with a longitudinal rear edge of the headlap portion of a previously installed shingle in the first course of shingles.

15. The roofing system according to claim 13, wherein said shingles further comprise a second set of alignment notches situated on the longitudinal rear edge of the headlap portion, wherein a first alignment notch from the second set of alignment notches lines up with the trailing lateral edge of a subsequently installed shingle in a first course of shingles.

16. The roofing system according to claim 1, wherein the non-straight longitudinal front-most edge includes a longitudinal front edge slot opening situated approximately at the longitudinal center of the shingle.

17. The roofing system according to claim 1, wherein the shingles further comprise sealant strips on the bottom side of the shingle situated near the non-straight longitudinal front-most edge.

* * * * *